United States Patent [19]

Devaud et al.

[11] Patent Number: 4,825,754

[45] Date of Patent: May 2, 1989

[54] VANE-TYPE ROTARY HYDRAULIC ACTUATOR DEVICE INTENDED FOR DRIVING AN AIRCRAFT CONTROL SURFACE

[75] Inventors: Gerald Devaud; Jean-Michel Rembliere, both of Paris, France

[73] Assignee: S.A.M.M.-Societe d'Applications des Machines Motrices, Bievres, France

[21] Appl. No.: 124,142

[22] Filed: Nov. 23, 1987

[30] Foreign Application Priority Data

Nov. 26, 1986 [FR] France ..... 86 16507

[51] Int. Cl.[4] ..... F01C 9/00

[52] U.S. Cl. ..... 92/122; 92/125

[58] Field of Search ..... 92/121, 122, 123, 124, 92/125, 67, 68; 91/380, 382, 368, 376 A, 509; 403/359

[56] References Cited

U.S. PATENT DOCUMENTS

| | | | |
|---|---|---|---|
| 1,876,104 | 9/1932 | Tucker | 92/122 |
| 2,960,076 | 11/1960 | Henry | 92/125 |
| 3,023,741 | 3/1962 | O'Connor | 92/125 |
| 3,128,679 | 4/1964 | Trendle | 92/125 |
| 3,276,332 | 10/1966 | Jaffe | 92/125 |
| 3,732,786 | 5/1973 | Grosseau | 92/124 |
| 4,272,224 | 6/1981 | Kabele | 403/359 |

FOREIGN PATENT DOCUMENTS

| | | | |
|---|---|---|---|
| 917585 | 7/1964 | Fed. Rep. of Germany | 92/122 |
| 2808769 | 9/1979 | Fed. Rep. of Germany | 92/67 |
| 0118678 | 10/1978 | Japan | 91/376 A |
| 0150561 | 11/1979 | Japan | 91/376 A |
| 113203 | 6/1968 | Norway | 92/125 |
| 569799 | 6/1945 | United Kingdom | 92/125 |

OTHER PUBLICATIONS

*Flight,* vol. LX, pp. 597–599, 11/9/51.

*Primary Examiner*—Robert E. Garrett
*Assistant Examiner*—Thomas Denion
*Attorney, Agent, or Firm*—Sughrue, Mion, Zinn, Macpeak, and Seas

[57] ABSTRACT

Rotary hydraulic actuator comprising a vane (1) which is mounted rotatably and sealingly in a chamber (2) made in a body (3) and on the faces of which a hydraulic fluid pressure is exerted, the vane being fixed mechanically to an element to be driven in rotation; the vane (1) comprises two parts (4, 5) extending radially on either side of its axis of rotation (XX), and these two parts are each movable in a chamber (8, 9) extending over an angular sector less than half a circumference, this chamber being divided into two compartments by the said part (4, 5); the actuator has a hydraulic circuit for feeding the chambers (8, 9), which is designed so as to be capable of driving the vane (1) in rotation in one direction or the other. This arrangement reduces the overall size of the actuator and increases its reliability.

5 Claims, 7 Drawing Sheets

VANE-TYPE ROTARY HYDRAULIC ACTUATOR DEVICE INTENDED FOR DRIVING AN AIRCRAFT CONTROL SURFACE

The subject of the present invention is a rotary hydraulic actuator intended for driving in rotation an element, such as an aircraft control surface. However, this use is not restrictive, and this actuator can be put into effect for driving a wide variety of elements.

The actuator with which the invention is concerned is of the type comprising a vane which is mounted rotatably and sealingly in a chamber made in a body and on the faces of which a hydraulic fluid pressure is exerted, the vane being fixed mechanically to the element to be driven in rotation.

According to the invention, the vane comprises at least two parts extending radially on either side of its axis of rotation, and these two parts are each movable in a chamber extending over an angular sector less than half the circumference, this chamber being divided into two compartments by the said part, and the actuator is equipped with a hydraulic circuit for feeding fluid to the chambers, which is designed so as to be capable of driving the vane in rotation in one direction or the other.

Thus, when the hydraulic pressure exerted on two opposite faces of the vane is higher than the pressure exerted on the other two faces, the vane rotates and drives in rotation the element fixed to its axle.

This solution is useful for ensuring the direct driving in rotation of a shaft or a pivot, whenever this rotation is less than one revolution, as occurs particularly with regard to a control surface of an aircraft (aeroplanes, helicopters).

In fact, in comparison with the devices known at the present time, its overall size is considerably less, all intermediate components, such as articulated connecting rods between the element to be driven and its control member, being omitted.

In accompaniment with this, the invention provides greater reliability than the known systems.

According to one embodiment of the actuator, the vane comprises four radial parts arranged at an equal angular distance from one another and rotating in four respective chambers, into each of which open an inlet conduit and an outlet conduit for the hydraulic fluid.

According to another particular feature of the invention, the hydraulic circuit has feed conduits formed in the body and in the central hub of the vane.

In one embodiment of the actuator, the hub has a shaft of a rotary distributor passing axially through it, on the periphery of which are formed passage grooves for the hydraulic fluid, and this shaft is designed to close off simultaneously the fluid-feed and fluid-return conduits when the distributor is in the position of equilibrium relative to the vane, whilst the rotation of this shaft through a specific angle puts the conduits of the body and of the vane hub in communication with one another, thereby causing a correlative rotation of the vane, with the position of the latter being subject to the new angular position of the shaft.

Other particular features and advantages of the invention will emerge from the following description, made with reference to the accompanying drawings which illustrate several embodiments of it by way of nonlimiting examples:

Figure 1:
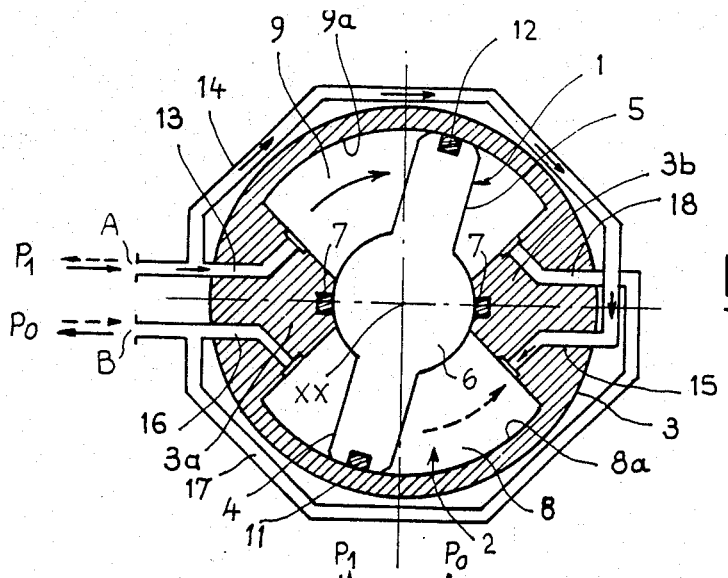
FIG. 1 is a cross-sectional view of a first embodiment of the rotary hydraulic actuator according to the invention.

The hydraulic actuator illustrated in FIG. 1 comprises a vane 1 which is mounted rotatably about an axis X—X in a chamber 2 made in a body 3 and on the faces of which a hydraulic fluid pressure can be exerted.

The vane 1 comprises 2 parts 4, 5 extending radially on either side of the axis of rotation X—X and a cylindrical central hub 6 integral with the two radial parts 4, 5. The hub 6 is in sealing contact with two radial protuberances 3*a*, 3*b* of the body 3, two gaskets 7 being received in these.

The hub 6 and the protuberances 3*a*, 3*b* divide the chamber 2 into two compartments 8, 9, the cylindrical walls 8*a*, 9*a* of which extend over at least half a circumference and are in sealing contact with the ends of the radial parts 4, 5 by means of the gaskets 11, 12 received in the grooves made at the ends of the said parts 4, 5.

The hydraulic circuit of this actuator comprises two pairs of similar conduits which feed hydraulic fluid to the compartments 8, 9: an inlet A opens, on the one hand, into a conduit 13 which is made in the body 3 and which opens into the chamber 9 and, on the other hand, into a branch 14 located outside the body 3 and extended by a conduit 15 in the body 3. The conduit 15 is diametrically opposite the conduit 13 and opens into the chamber 8 on the opposite side to the conduit 13.

As a complement to this, a fluid outlet B communicates, on the one hand, with a conduit 16 opening into the chamber 8 on the side of the radial part 4 opposite to that where the conduit 15 opens and, on the other hand, with a branch 17 located outside the body 3. This branch 17 is extended by a conduit 18 in the body 3, which is diametrically opposite the conduit 16 and which opens into the part of the compartment 9 opposite that which receives the conduit 13.

If a hydraulic fluid at the pressure P1 is introduced via the inlet A, this fluid runs through the conduits 13, 14, 15 along the path indicated by the arrows, so as to feed the respective compartments 9 and 8 and, more specifically, the sub-compartments contained between the vane 1 and the walls of the body 3, in which are made the conduits 13, 15. Thus, the vane 1 rotates about the axis X—X in the direction of the arrow represented by an unbroken line (the clockwise direction), whilst the fluid at the pressure P0 is expelled from the two sub-compartments opposite the two sub-compartments receiving the pressure P1 and returns to the tank via the conduits 16, 17 and 18.

Conversely, if the pressure P1 higher than P0 is exerted at the inlet B, the vane 1 rotates in the opposite direction to the preceding direction, and the fluid returns to the tank via the conduits 13, 14 and 15, as indicated by the arrows represented by broken lines.

The vane 1 is fixed by means of its hub 6 to the element to be driven in rotation (not shown) which can be, for example, an aircraft control surface.

Figure 2:
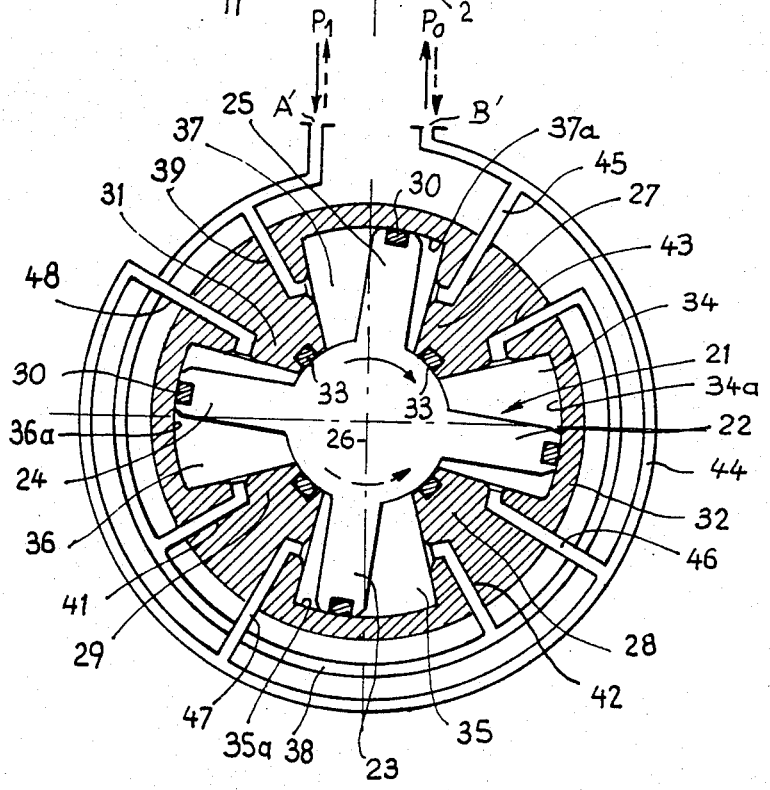
FIG. 2 is a cross-sectional view, similar to that of FIG. 1, of a second embodiment of the actuator according to the invention.

In the second embodiment illustrated in FIG. 2, the vane 21 comprises four radial parts 22, 23, 24, 25 arranged at an equal angular distance from one another, and a central hub 26 integral with the parts 22 to 25. The hub 26 is in sealing contact with the ends of four radial extensions 27, 28, 29, 31 of the body 32 by means of four gaskets 33. These four extensions 27 to 31 delimit between them four chambers 34, 35, 36, 37 having cylindrical outer walls 34*a*, 35*a*, 36*a*, 37*a* in sealing contact with the ends of the radial parts 22 to 25 by means of gaskets 30 received in the ends of the said radial parts 22 to 25.

The hydraulic circuit feeding this actuator is composed as follows: a fluid inlet A′ feeds an annular conduit 38 located outside the body 32 and communicating with four radial conduits 39, 41, 42, 43 passing through the body 32 and opening into the respective compartments 37, 36, 35, 34 opposite the corresponding faces of the four radial parts 25, 24, 23, 22. As a component to this, a fluid outlet B′ communicates with a peripheral conduit 44 located outside the body 32 and feeding four radial conduits 45, 46, 47, 48 passing through the body 32 and opening into the respective compartments 37, 34, 35, 36 on the side of the radial parts 25, 22, 23, 24 opposite the conduits 39, 43, 42, 41.

If a hydraulic pressure P1 is exerted at the inlet A′, the fluid travels along the path indicated by the arrows represented by unbroken lines and exerts on the radial parts 25, 22, 23, 24 of the vane 21 the pressure P1 which causes the vane to rotate in the clockwise direction. In correlation with this, the fluid at the pressure P0, less than P1, is expelled from the opposite compartments of the chambers 34 to 37 via the conduits 45 to 48 and the conduit 44, up to the outlet B′ leading to the tank. Of course, the vane 21 rotates in the opposite direction to the preceding direction if the pressure P1 is exerted at B′, whilst the outlet A′ is at the pressure P0.

A third embodiment of the actuator will now be described with reference to FIGS. 3, 4A, 4B, 5A and 5B.

Here, the vane 51 consists of two diametrically opposite radial parts 52, 53 integral with a cylindrical central hub 54. The parts 52 and 53 can move angularly about the axis X—X of the hub 54 in chambers 55, 56 formed in a body 57. Sealing between the two compartments of each chamber 55, 56 is ensured by means of the gaskets 58 received in grooves in the ends of the radial parts 52, 53, whilst sealing between the hub 54 and the body 57 is obtained by means of gaskets 59 seated in diametrically opposite grooves in the body 57.

Here, the hydraulic circuit comprises return conduits 61 at the pressure of the tank R, which are machined in the hub 54 and the diametrically opposite ends of which open out opposite two transverse grooves 62 made on the periphery of a central shaft 63 received in an axial bore of the hub 54. In the latter there are also four radial conduits 64, 65, 66, 67. The conduits 64, 65 open into two opposite compartments of the chamber 55 which are separated by the radial part 52, whilst the conduits 66, 67 open into the two compartments of the chamber 55 which are separated by the radial part 53. The grooves 62 are machined in a portion 63*a* of cylindrical cross-section of the shaft 63. This portion 63*a* defines the distribution characteristics of the system.

Two conduits 68 for feeding hydraulic fluid at the pressure P supplied by a hydraulic source (not shown) are formed within the hub 54 between the conduits 64 and 65 on the one hand and the conduits 66 and 67 on the other hand.

Figure 4A:
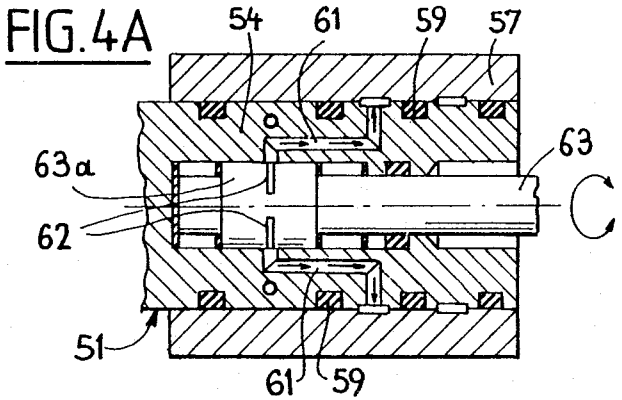
FIGS. 4A and 4B are respectively a view in longitudinal section and a partial elevation view of the actuator according to 4A—4A and 4B—4B of FIG. 3.
Figure 4B:
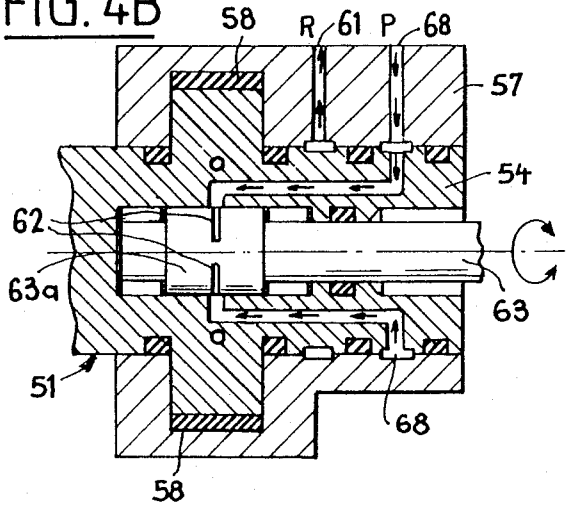
Figure 3:
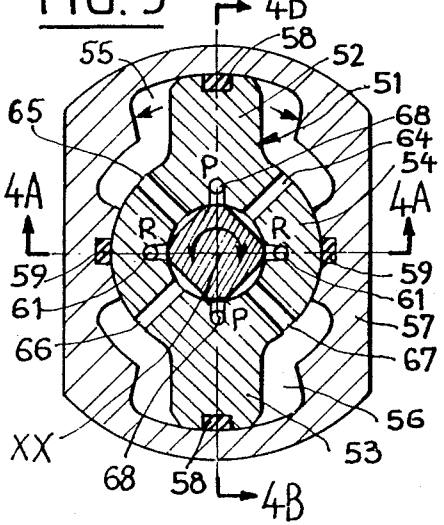
FIG. 3 is a simplified cross-sectional view of a third embodiment of the actuator according to the invention.
Figure 7:
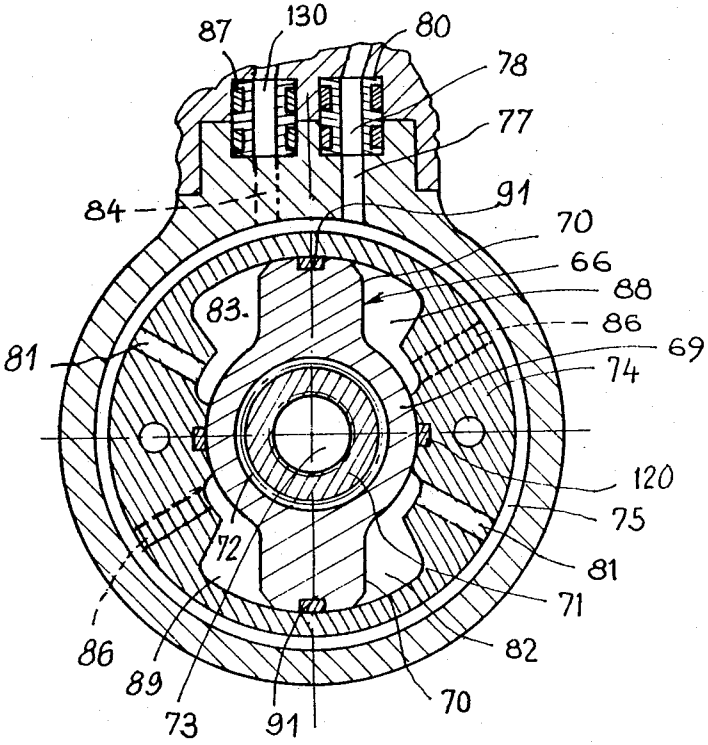
FIG. 7 is a cross-sectional view according to 7—7 of FIG. 6.
Figure 6:
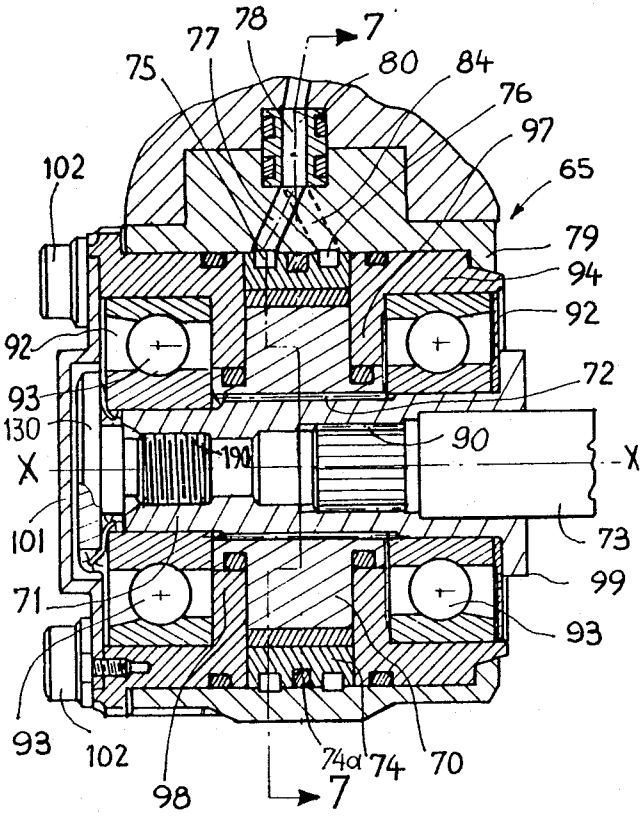
FIG. 6 is a view in longitudinal section and partial elevation of an industrial embodiment of the actuator according to the invention.
Figure 8:
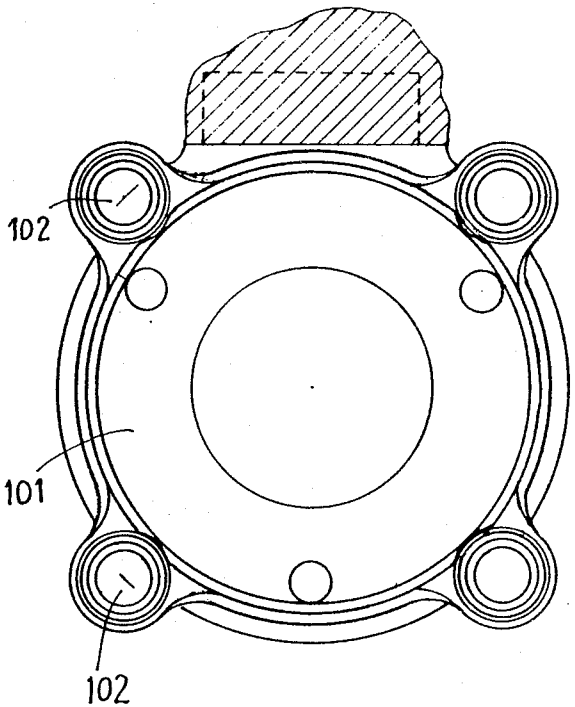
FIG. 8 is an elevation view of the end of the actuator of FIGS. 6 and 7.

The mode of operation of the actuator of FIGS. 3 and 4A–4B is explained with reference to FIGS. 5A and 5B. At rest, the actuator is in the position shown in FIG. 3, where it can be seen that the conduits 61 and 68 are closed off by the rounded vertices of the central portion 63*a* of the shaft 63, so that no fluid circulates in the actuator.

If the shaft 63 is rotated through a specific angle in the clockwise direction (FIG. 5A), the portion 63*a* of the shaft 63 exposes the feed conduits 68 which then communicate with the respective conduits 65 and 67. The fluid at the pressure P thus fills the compartments of the chambers 55, 56, thereby causing the vane 51 to rotate in the clockwise direction, whilst the fluid at the pressure R flows off from the other two compartments of the chambers 55, 56 via the conduits 64, 66, 61 towards the tank at the pressure R.

Figure 5A:
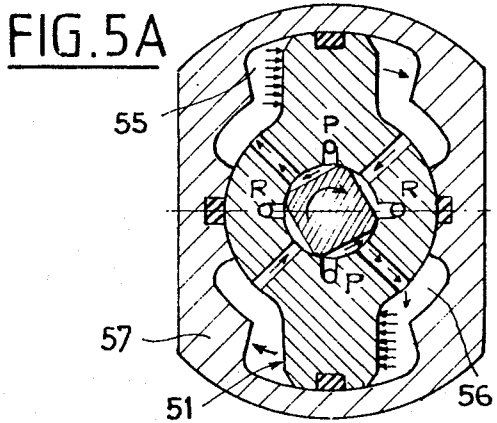
FIGS. 5A and 5B are diagrammatic views corresponding to FIG. 3 and showing the distribution of the hydraulic pressures when the vane is driven in the clockwise direction (FIG. 5A) or in the anticlockwise direction (FIG. 5B)
Figure 5B:
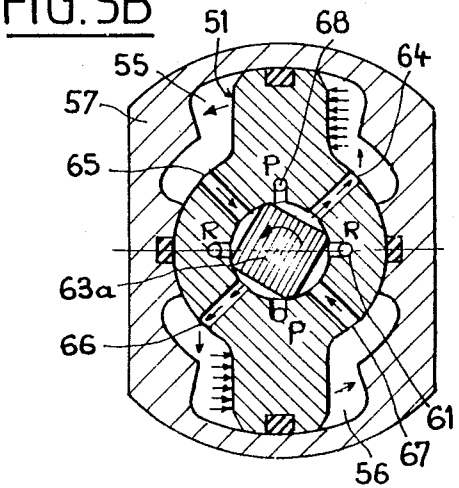

The circuit followed by the hydraulic fluid, the pressure exerted by the latter and the rotation of the vane 51 are symbolized by the arrows marked in FIG. 5A.

The vane 51 continues to rotate until the conduits 68 and 61 are once again closed off by the portion 63*a* of the shaft 63, the vane 51 then having "copied" the new angular position of the latter and coming to a stop.

If the shaft 63 experiences a rotation in the anticlockwise direction (FIG. 5B), this rotation puts the conduits 68 and 64, 66 in communication with one another, so that the fluid causes the vane 51 likewise to rotate in the anticlockwise direction and leaves at the pressure R via the conduits 65 and 67. As before, the rotation of the vane 51 stops when the conduits 61 and 68 are closed off once more by the portion 63*a*, the position of which has been "copied" by the vane 51.

In this particular use, therefore, the actuator functions as a device for copying the angular position of a control shaft.

In the embodiment illustrated in FIGS. 6 to 9, the actuator 65 is equipped with a vane 66 comprising two diametrically opposite radial parts 70 joined by means of an annular piece 69 and a hub 71 of annular cross-section which passes axially through the annular piece 69. The latter is fixed in rotation with the hub 71 by means of matching axial splines, such as 72. Likewise, to ensure that the shaft 73 seated in the axial recess of the hub 71 and fixed to an element (not shown) is driven in rotation, there is any suitable means, such as matching axial splines 90 formed on the periphery of the shaft 73 and in the inner wall of the hub 71. On the opposite side to the shaft 73, a bolt 130 provided with a thread 190 is screwed into an internal thread of the hub 71 coaxially relative to the shaft 73 and makes it possible to clamp the bearings 92, 93.

The actuator 65 also possesses an annular body 74 which surrounds the radial parts 70 and the central piece 69 and on the periphery of which are machined two circumferential grooves 75, 76 coaxial relative to the general axis Y—Y of the actuator. The groove 75 communicates, on the one hand, with a feed conduit 77, 78 made in an outer casing 79 and a sleeve 80 and, on the other hand, with two radial conduits 81 made in the body 74 and opening into respective chambers 82, 83. In like manner, the groove 76 communicates, on the one hand, with a feed conduit 84 made in the casing 79 and opening into a bore 130 of a second sleeve 87 and, on the other hand, with two radial conduits 86 located in the body 74 and opening into the other two hydraulic chambers 88, 89. The body 74 is equipped with an annular gasket **74*a* seated in a groove which is located in the body and which is formed between the grooves 75, 76**.

The chambers 82, 83 and 88, 89 are delimited by the body 74, by the radial parts 70 and by the central piece 69. The latter and the radial parts 70 are mounted sealingly relative to the body 74 by means of gaskets 91, 120 received in the respective grooves in the body 74 and in the ends of the radial parts 70.

The actuator 65 is also equipped with two bearings 92 which have balls 93 and which are interposed between the hub 71 and an annular body 94 contained in the casing 79. The latter is equipped with two radial collars 97, 98 inserted between the radial parts 70 and the bearings 92 which, in a complimentary way, are held in place axially by means of an end collar 99 of the hub 71. The assembly is closed, on the opposite side to the collar 99, by means of a cover 101 retained by fastening screws 102 engaged in the casing 94.

When the hydraulic fluid under feed pressure enters the conduits 78, 77 and the groove 75, this fluid reaches the two opposite chambers 82, 83 via the radial perforations 81 and causes the vane 66 to rotate in the clockwise direction. The fluid returns to the tank from the chambers 88, 89 via the conduits 86, the groove 76, the conduit 84 and the sleeve 87. This rotary movement is reversed if the hydraulic pressure is supplied via the groove 76.

Figure 10:
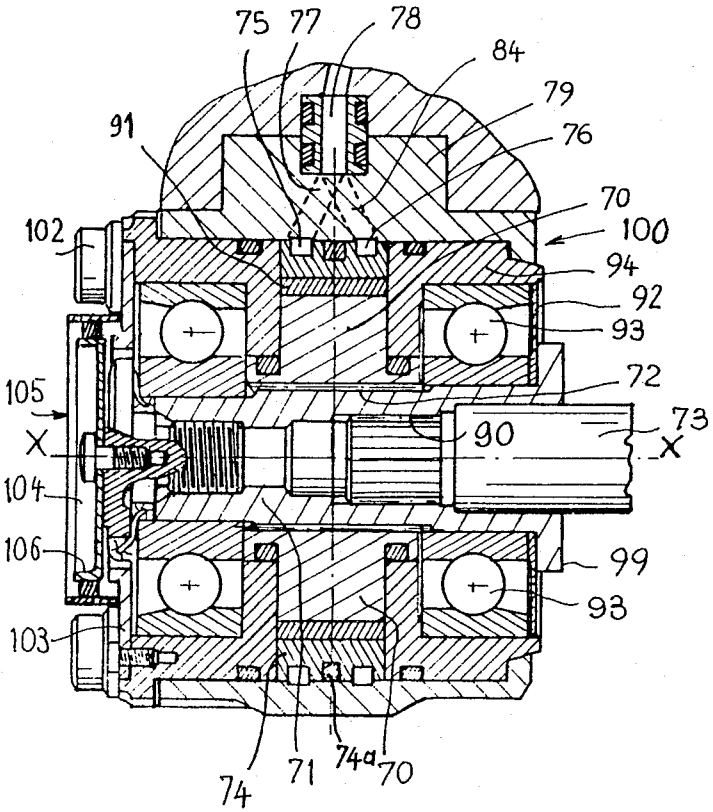
FIG. 10 is a cross-sectional and partial elevation view similar to that of FIG. 6, illustrating the use of the actuator for controlling an electrical potentiometer.
Figure 9:
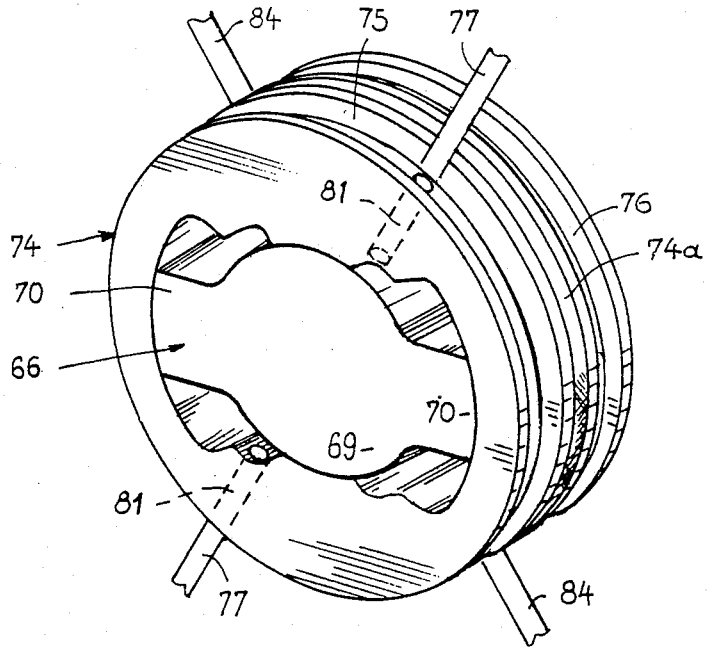
FIG. 9 is a partial perspective view of the actuator of FIGS. 6 to 8, showing a body encasing the rotary vane and the connections of the hydraulic circuit.

FIG. 10 shows an actuator 100 identical to the actuator 65, except that its cover 101 is replaced by a collar 103 which receives the end 104 of an electrical potentiometer 105 having the shaft 73. This potentiometer 105 is equipped with a slide 106 driven in rotation in a way known per se by means of the shaft 73 in response to the resistance of the potentiometer, when this shaft is itself rotated, as described above with reference to FIGS. 6 to 9.

Alternatively, it is possible to associate any rotary position-detecting element with the shaft 73 of the actuator 65, 100, the potentiometer 105 being given only as an example. Such an arrangement makes it possible to insert these elements in an electro-hydraulic control loop.

Figure 12:
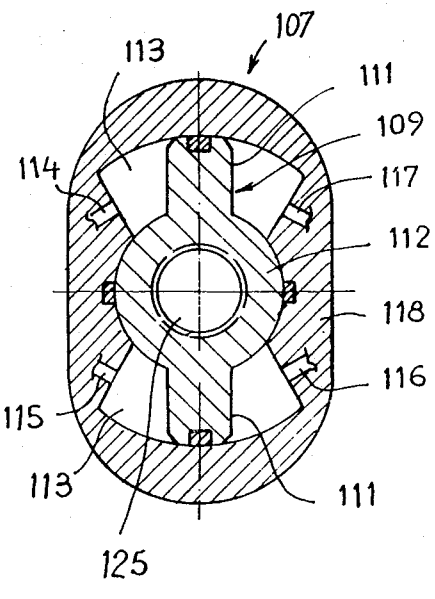
FIG. 12 is a cross-sectional view of one of the actuators according to 12—12 of FIG. 11.
Figure 11:
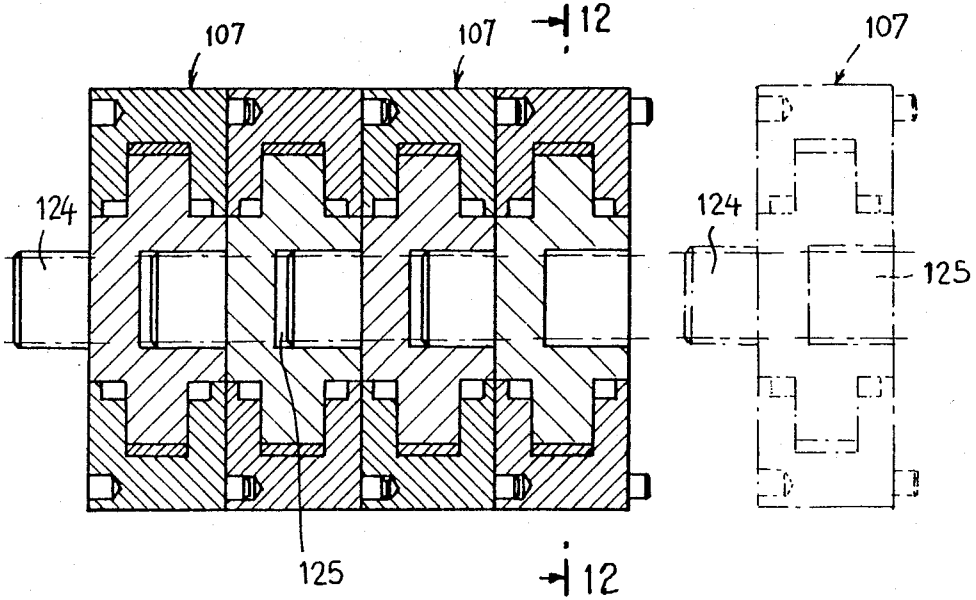
FIG. 11 is a diagrammatic longitudinal elevation view illustrating the use of several actuators arranged in series coaxially relative to a common shaft.

FIGS. 11 and 12 illustrate a series connection of several coaxial actuators 107, each vane 109 of which is equipped with a male/female coupling 124, 125, the male elements 124 fitting into the female elements 125. Each actuator 107 is of the type shown in FIG. 1, and its vane 109 therefore comprises, in addition to the coupling 124-125, two radial parts 111 which are connected by means of a central hub 112 and which can move angularly in two chambers 113 fed via perforations 114, 115, 116, 117 made in the body 118.

Since each actuator 107 has its own hydraulic circuit, the series connection of several coaxial actuators 107 makes it possible to ensure the redundancy necessary for safety reasons where the actuation of an aircraft control surface is concerned.

In all the embodiments described, the chambers or compartments (8, 9; 55, 56; 83 to 88, 82; 113) extend over angular sectors less than half a circumference.

Figure 13:
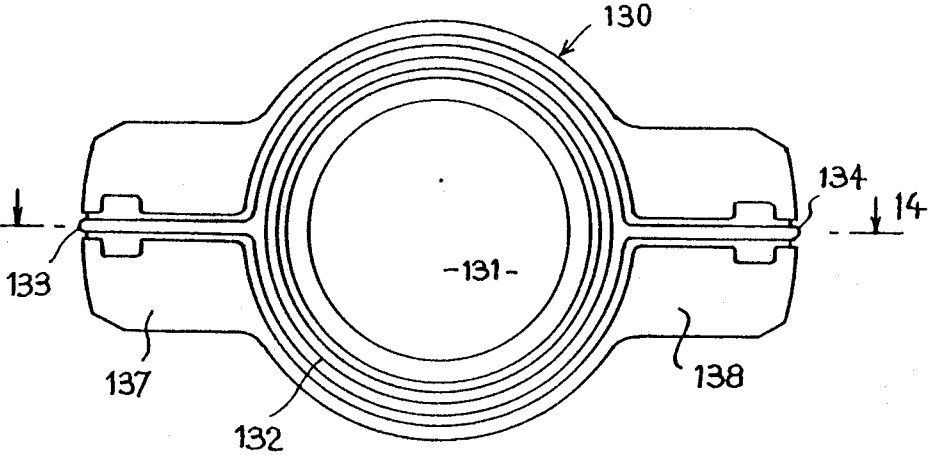
FIG. 13 is a plan view of an alternative embodiment of a vane of an actuator according to the invention.
Figure 14:
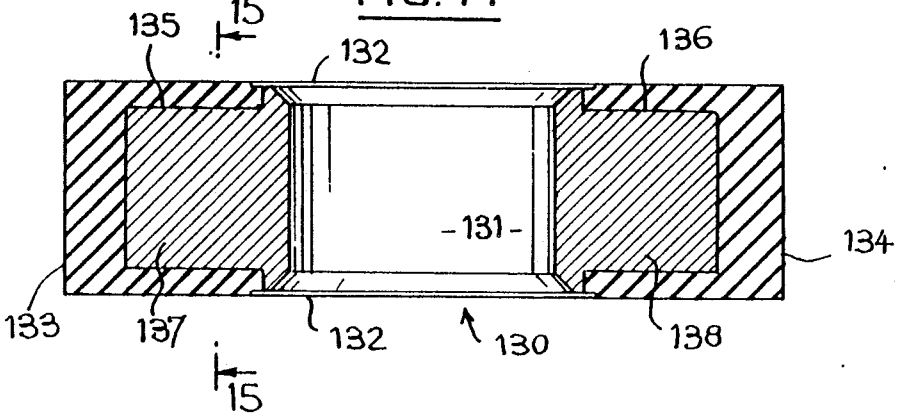
FIG. 14 is a sectional view of the vane of FIG. 13 according to 14—14.
Figure 15:
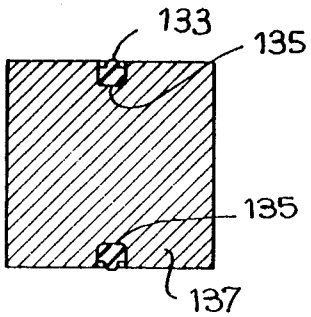
FIG. 15 is a cross-section according to 15—15 of FIG. 14.

The vane 130 of FIGS. 13 to 15 is equipped, on the two opposite faces of its hub 131, with two sealing rings 132 connected by means of sealing cords 133, 134 extending in diametric extensions of the rings 132. The rings and the cords 133, 134 are seated in corresponding grooves 135, 136 made in the opposite faces of the hub 131 and in the radial parts 137, 138 of the vane 130. The cords 133, 134 extend on either side of the hub 131 in a plane containing a diameter of the rings 132. The latter and the cords 133, 134 ensure excellent sealing between the vane 130 and the wall of the chamber of the actuator.

What is claimed is:

1. Rotary hydraulic actuator device comprising a vane (1, 21, 51, etc.) which is mounted rotatably and sealingly in a chamber (2; 34, 35, etc.) made in a body (3, 32, 74, etc.) and on the faces of which a hydraulic fluid pressure can be exerted, the vane being fixed mechanically to an element to be driven in rotation, characterized in that: the vane (2, 21, 51, etc.) comprises at least two parts (4, 5) extending radially on either side of its axis of rotation (XX), and these two parts are each movable in a chamber (8, 9; 55, 56, etc.) extending over an angular sector less than half a circumference, this chamber being divided into two compartments by the said part (4, 5; 52, 53; 67, 68); in that it is equipped with a hydraulic circuit for feeding fluid to the chambers (8, 9; 55, 56), which is designed so as to be capable of driving the vane (1, 21, 51, 66) in rotation in one direction or the other; and in that the vane (66) comprises two diametrically opposite radial parts (70) joined by means of a central piece (69) receiving a hub (71) which is fixed to the said rotating radial parts and in which is formed an axial recess receiving a shaft (73) fixed to the element to be driven and to the hub (71) the ends of the radial parts (70) and the hub (71) being in sealing sliding contact with the body (74) which surrounds the vane (66) and which has, on its periphery, two circumferential grooves (75, 76) each communicating, on the one hand, with hydraulic-fluid passage conduits, (77, 78, 84) made in a casing (79) containing the annular body (74) and the vane (66) and, on the other hand, with respective radial inlet perforations (81, 82) in the chambers (82, 88) and outlet perforations (86, 87) from the latter, which are made in the annular body (74), said circumferential grooves (75, 76) being located entirely within a radial extension of said radial parts (70).

2. Actuator device according to claim 1, characterized in that it is equipped with rolling bearings (92) interposed between the hub (71) of the vane (66) and the casing (79) and mounted sealingly in respect of the hydraulic-fluid chambers.

3. Actuator device according to claims 1 and 2, characterized in that the vane (66) and its hub (71) are fixed to one another in terms of rotation by means of matching axial splines (72), as are the shaft (73) and the hub (71).

4. Device according to claim 3, characterized in that it comprises a series of actuators (107) having vanes (109) which are each equipped with a male/female coupling (124-125), these being fitted into one another, each actuator having its own hydraulic circuit.

5. Device according to claim 3, characterized in that the vane (130) has two circular sealing rings (132) on its two opposite faces and sealing cords (133, 134) seated in respective circular grooves in the faces of the hub (131) and formed radially round the radial parts (137, 138) of the vane in a plane containing a diameter of the rings (132).

* * * * *